US011699845B2

(12) United States Patent
Köstermann et al.

(10) Patent No.: US 11,699,845 B2
(45) Date of Patent: Jul. 11, 2023

(54) ANTENNA DEVICE

(71) Applicant: VOLKSWAGEN AKTIENGESELLSCHAFT, Wolfsburg (DE)

(72) Inventors: Janis Köstermann, Berlin (DE); Hendrik Hoppmann, Braunschweig (DE); Hans-Guenter Nieper, Groß Twülpstedt (DE); Stefan Paul, Braunschweig (DE); Michael Ponitka, Magdeburg (DE)

(73) Assignee: Volkswagen Aktiengesellschaft

( * ) Notice: Subject to any disclaimer, the term of this patent is extended or adjusted under 35 U.S.C. 154(b) by 52 days.

(21) Appl. No.: 17/510,629

(22) Filed: Oct. 26, 2021

(65) Prior Publication Data

US 2022/0149513 A1 May 12, 2022

(30) Foreign Application Priority Data

Nov. 6, 2020 (DE) ..... 10 2020 213 995.4

(51) Int. Cl.
*H01Q 1/08* (2006.01)
*H01Q 1/36* (2006.01)
*H01Q 1/32* (2006.01)

(52) U.S. Cl.
CPC ..... *H01Q 1/36* (2013.01); *H01Q 1/08* (2013.01); *H01Q 1/32* (2013.01)

(58) Field of Classification Search
CPC ..... H01Q 1/08; H01Q 1/085; H01Q 1/22; H01Q 1/2241; H01Q 1/36; H01Q 1/32; H01Q 1/3275
See application file for complete search history.

(56) References Cited

U.S. PATENT DOCUMENTS

| | | | | |
|---|---|---|---|---|
| 7,800,548 | B2 | 9/2010 | Baginski et al. | |
| 10,347,962 | B1 * | 7/2019 | Georgakopoulos | H01Q 1/362 |
| 10,658,741 | B1 | 5/2020 | Zekios et al. | |
| 2006/0281382 | A1 * | 12/2006 | Karayianni | D02G 3/32 442/306 |
| 2010/0163283 | A1 * | 7/2010 | Hamedi | D03D 15/258 174/254 |
| 2013/0020313 | A1 * | 1/2013 | Swallow | D03D 1/0088 219/545 |
| 2014/0170920 | A1 * | 6/2014 | Manipatruni | D03D 1/0088 442/187 |
| 2018/0076510 | A1 * | 3/2018 | Kitchener | D02G 3/44 |
| 2018/0327984 | A1 | 11/2018 | Xie | |

FOREIGN PATENT DOCUMENTS

| | | | |
|---|---|---|---|
| CN | 209907243 | U | 1/2020 |
| DE | 102004026528 | A1 | 9/2005 |
| DE | 202007006339 | U1 | 7/2007 |
| DE | 102006011596 | A1 | 9/2007 |
| DE | 102007032191 | A1 | 1/2009 |

* cited by examiner

*Primary Examiner* — Thai Pham

(74) *Attorney, Agent, or Firm* — Barnes & Thornburg, LLP

(57) ABSTRACT

An antenna device, a transportation vehicle, and a textile article having an antenna device. The antenna device includes conductive filaments woven into a carrier fabric, wherein the conductive filaments form an antenna structure and are a contacting structure at a first end.

8 Claims, 5 Drawing Sheets

ANTENNA DEVICE

PRIORITY CLAIM

This patent application claims priority to German Patent Application No. 10 2020 213 995.4, filed 6 Nov. 2020, the disclosure of which is incorporated herein by reference in its entirety.

SUMMARY

Illustrative embodiments relate to an antenna device, in particular, a flexible antenna device. Illustrative embodiments furthermore relate to a textile article and to a transportation vehicle having the disclosed antenna device.

BRIEF DESCRIPTION OF THE DRAWINGS

Disclosed embodiments will be described in further detail with reference to the drawings, in which.

DETAILED DESCRIPTION

Figure 1:
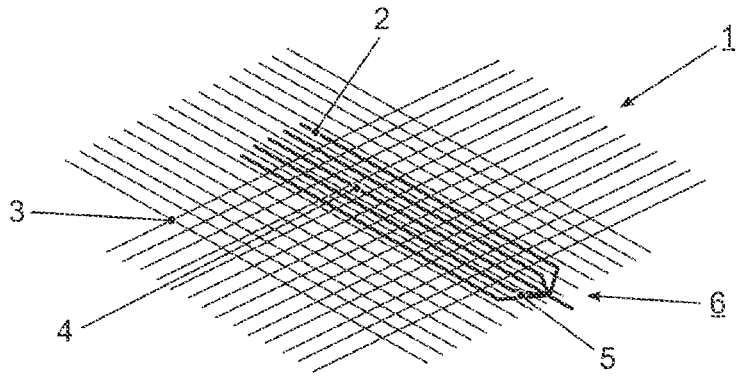
FIG. 1 schematically shows an exemplary antenna device.

In the scope of the progressive development of automated driving, increasing proliferation of the use of Car2X communication is observable, a technique by which transportation vehicles can communicate with one another and with their environment. One challenge is that Car2X links need to be set up from small objects, for example, traffic cones. Specifically, the problem arises of how an antenna with a size sufficient to achieve a corresponding antenna gain can be accommodated in a traffic cone. One particular problem is that traffic cones may be foldable and the body may consist of textile fabric.

In known solutions, fixed antennas are essentially used. As an alternative, the use of individual insulated stranded conductors or structures printed onto glass, ceramic, boards or other materials is also known. Fixed antennas, however, do not allow foldability. Individual insulated stranded conductors entail the risk of becoming caught, tearing, etc.

Against this background, U.S. Pat. No. 10,347,962 B1 describes a foldable antenna having a lower encapsulation layer, a multiplicity of origami substrates which are arranged on the lower encapsulation layer, an upper encapsulation layer which is arranged on the multiplicity of origami substrates, and a conductive track, which is arranged on the upper encapsulation layer. The conductive track consists of conductive antenna elements, which may be formed from conductive fabric tape, conductive filaments, conductive tape, conductive wire or a microfluidic channel with liquid metal.

U.S. Pat. No. 10,658,741 B1 describes an antenna device having a foldable substrate and an antenna element arranged thereon. The antenna element may be arranged in a polygonal shape, such as a rectangle or a square, on the substrate. The substrate may have predefined folding lines so that the substrate can be folded into various positions.

DE 10 2006 011 596 A1 describes a transponder for textile fabric, the transponder comprising an antenna and a chip module electrically and mechanically connected thereto. At least one electrically conductive wire or filament constituting the antenna is woven together into the textile fabric. Connection pads of the chip module, which is arranged on the outside relative to the textile fabric, are electrically and mechanically connected to a connecting region of the wire or filament by using adhesive films, which are arranged between them and pass through the textile fabric.

DE 10 2007 032 191 A1 describes a stacker truck having at least one antenna for transmitting and receiving data from and/or to RFID transponders. The antenna comprises a network of wires, which are embedded into a flexible material.

DE 20 2007 006 339 U1 describes an asymmetric oscillator, which is interlaced as a metal stranded conductor or a wire into a fabric or another piece of clothing.

The disclosed embodiments provide an antenna device which is distinguished by an improved foldability. This is achieved by an antenna device.

According to a first disclosed embodiment, an antenna device comprises conductive filaments which are woven into a carrier fabric, the conductive filaments forming an antenna structure and being configured as a contacting structure at a first end.

In the disclosed solution, conductive filaments, for example, metal filaments, are woven into a carrier fabric, for example, a textile fabric. The conductive filaments form an antenna structure. The disclosed antenna device is beneficial because it is foldable and is therefore also suitable for use in articles which can be folded up. By the weaving of the conductive filaments into a carrier fabric, they are protected well against damage. Furthermore, it is possible to produce both simple antenna structures, which replicate for example, a rod antenna, and more complex antenna structures, which, for example, replicate a patch antenna. There is furthermore the possibility that the antenna structure replicates a structure consisting of deflectors and reflectors.

Because of the configuration as a contacting structure, contact with a transmitter unit or receiver unit to be attached may be established at a suitable location.

According to at least one disclosed embodiment, the conductive filaments are woven out from the carrier fabric at the first end and combined to form a stranded conductor as a contacting structure. In a simple case, they are merely twisted to form a stranded conductor. They may however also be firmly connected to one another, for example, by soldering. Combining the conductive filaments to form a stranded conductor is beneficial because such a stranded conductor is highly suitable as a contact of the antenna device for an apparatus to be connected.

According to at least one disclosed embodiment, the conductive filaments form a two-dimensional structure or an annular structure at the first end in the carrier fabric as the contacting structure. Such a two-dimensional or annular structure is beneficial because an enlarged region is provided for the contacting of the antenna device. This makes it easier to establish the contacting.

According to at least one disclosed embodiment, the contacting structure is provided with a plug-in connector fastened in the carrier fabric. Connection of the antenna device to an apparatus is further simplified by a plug-in connector. Furthermore, fastening the plug-in connector in the carrier fabric ensures that mechanical loads of the attachment of the contacting structure to the plug-in connector when plugging in or unplugging a connection jack are significantly reduced.

According to at least one disclosed embodiment, the contacting structure is contacted by a rivet. A rivet may be introduced easily into the fabric, for example, with a pair of rivet pliers. It is furthermore fastened securely in the fabric, so that long-term durability of the contacting is ensured even in robust working environments.

According to at least one disclosed embodiment, the contacting structure is configured in such a way that the antenna device can be coupled to an apparatus by using a coupling antenna. This is beneficial because a plug-in connector in the carrier fabric or another type of electromechanical contacting may be avoided. A link between the antenna device and an apparatus to be connected is in this case formed only by the spatial proximity.

An exemplary antenna device is particularly beneficial used in a textile article, that is to say an article consisting of a textile fabric such as a textile cloth or a similar fabric. The textile article may, for example, be a tent, a foldable traffic cone, a piece of clothing or a wearable, in particular, an armband.

According to at least one disclosed embodiment, the textile article is foldable and the antenna structure can be stabilized or redefined by the unfolding. By the foldability of the textile article, it may be stowed in a space-saving way. There is furthermore the possibility of stabilizing the antenna structure by the unfolding. The shape of the antenna structure may furthermore be converted from a first shape into a second shape by the unfolding. This makes it possible to vary transmission or reception properties of the antenna device. According to at least one disclosed embodiment, the textile article can be folded in multiple stages in such a way that a shape or length of the antenna structure can be varied. The antenna gain or the useful frequency may be adapted deliberately by varying the shape or length of the antenna structure.

According to at least one disclosed embodiment, the textile article can be folded out in such a way that the antenna structure has a defined placement relative to a solid structure. In this way, for example, a larger metal surface at a defined distance from the antenna structure may be used as ground. Applications of such a solution are, for example, a metal bottom plate in a cone having an antenna device or bodywork parts in the case of an antenna device in a roof of a convertible.

Beneficial integration of an exemplary antenna device is furthermore possible in a transportation vehicle. The transportation vehicle may be an automobile or a commercial vehicle, or alternatively a vessel, a rail vehicle, an aircraft, for example, a Volocopter, etc. The antenna device may, for example, be integrated into upholstery of seats, into convertible roofs or into tarpaulins or coverings, for example, on trucks or trailers. With integration into tarpaulins or coverings, particularly large antenna structures may be produced for high antenna gains or low-frequency applications. Furthermore, an element which is freely influenced in shape, for instance, a metal brace on a roof, a crosspiece or a strut, may deliberately be used as part of the overall antenna structure. In this case, there is the possibility of electrically contacting only the fixed structure and of placing only elements which are not conductively attached, and which function, for example, as reflectors or deflectors, in the carrier fabric.

For better understanding of the principles of the disclosure, exemplary embodiments will be explained in more detail below with the aid of the figures. It should be understood that the disclosure is not restricted to these disclosed embodiments and that the features described may also be combined or modified without departing from the protective scope of the disclosure, as it is defined in the appended claims.

FIG. 1 schematically shows an exemplary antenna device 1. Conductive filaments 2, for example, metal filaments, are woven into an into a carrier fabric 3, for example, a textile fabric. The conductive filaments 2 form an antenna structure 4. Simple antenna structures 4, which replicate a rod antenna, as well as more complex antenna structures 4, for example, a patch antenna or a structure consisting of deflectors and reflectors, are equally possible in this case. The conductive filaments 2 are configured as a contacting structure 6 at a first end 5, so that contact with a transmitter unit or receiver unit to be attached may be established electromechanically at a suitable location. As an alternative to electromechanical coupling of the apparatus to be attached, there is the possibility of carrying out coupling by a coupling antenna. In this way, the electromechanical contact may be obviated and a link between the antenna device 1 and the apparatus is formed only by the spatial proximity.

Figure 2:
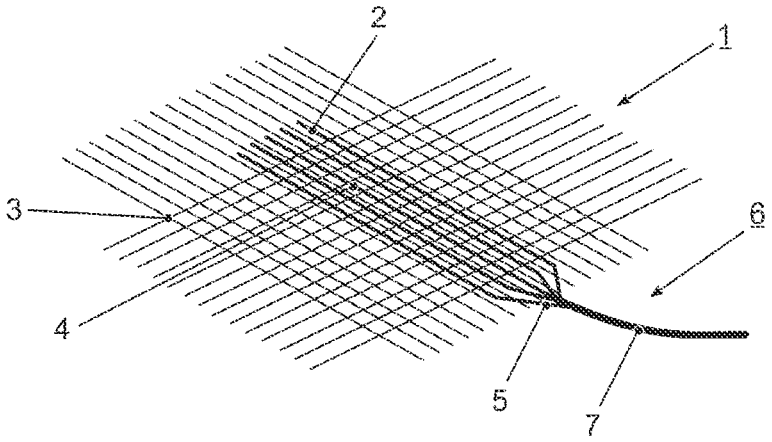
FIG. 2 shows an exemplary embodiment of the disclosed antenna device with a stranded conductor as the contacting structure.

FIG. 2 shows an exemplary embodiment of the antenna device 1 with a stranded conductor 7 as the contacting structure 6. In this disclosed embodiment, the ends 5 of the conductive filaments 2 are woven out from the carrier fabric 3. The ends 5 woven out are combined to form a stranded conductor 7. In a simple case, they are merely twisted to form a stranded conductor. They may however also be firmly connected to one another, for example, by soldering. Such a stranded conductor 7 is highly suitable as a contact of the antenna device 1 for an apparatus to be connected.

Figure 3:
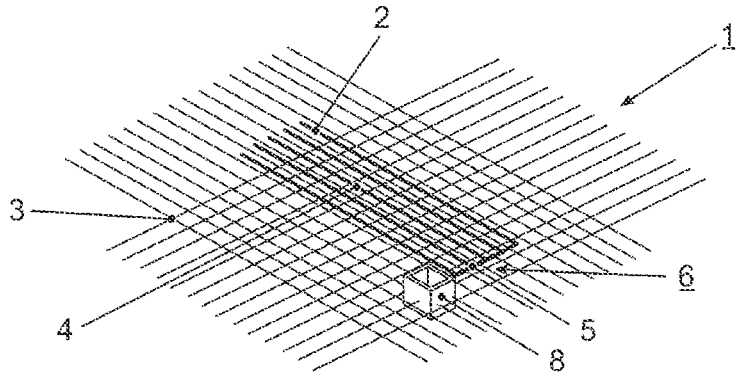
FIG. 3 shows an exemplary embodiment of the disclosed antenna device with a plug-in connector.

FIG. 3 shows an exemplary embodiment of the antenna device 1 with a plug-in connector 8. The plug-in connector 8 is fastened in the carrier fabric 3 and may be contacted by a corresponding jack. The plug-in connector 8 simplifies the connection of the antenna device 1 to an apparatus. By using suitable fabric structures, strain relief may be achieved for the plug-in connector 8. This ensures that mechanical loads of the attachment of the contacting structure 6 to the plug-in connector 8 when plugging in or unplugging a connection jack are significantly reduced.

Figure 4:
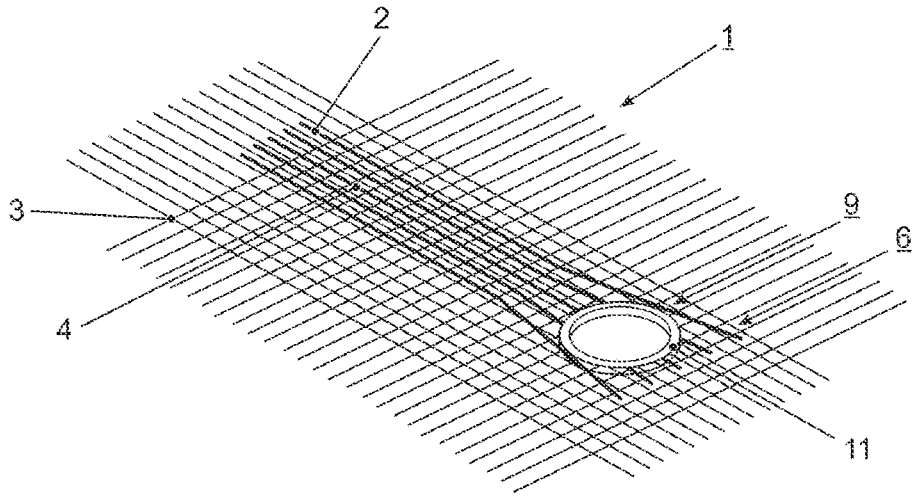
FIG. 4 shows an exemplary embodiment of the disclosed antenna device with a two-dimensional structure as the contacting structure.

4 shows an exemplary embodiment of the antenna device 1 with a two-dimensional structure 9 as the contacting structure 6. To form the two-dimensional structure 9, the conductive filaments 2 in the carrier fabric 3 are woven out at the end of the antenna structure 4 over a wider area. The two-dimensional structure 9 is particularly highly suitable for contacting with a rivet 11, as represented in FIG. 4. Such a rivet 11 may, for example, be introduced into the carrier fabric 3 with a pair of rivet pliers. It is fastened securely in the fabric, so that long-term durability of the contacting is ensured.

Figure 5:
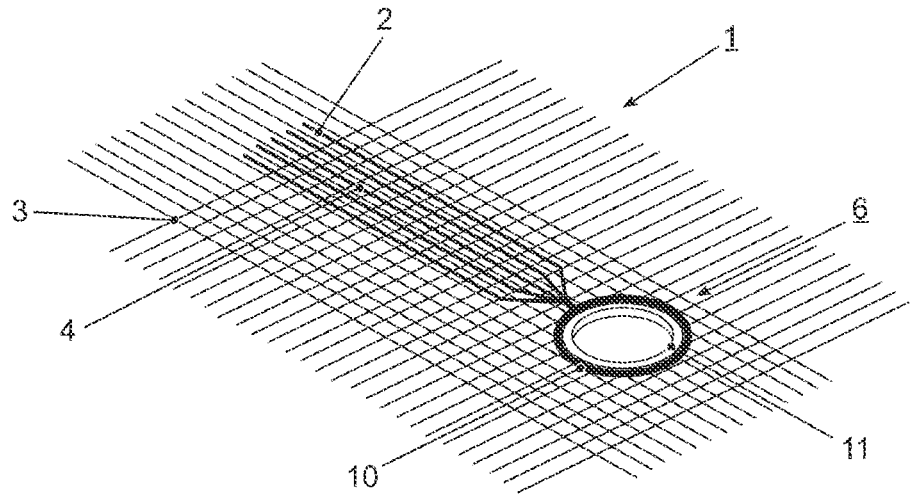
FIG. 5 shows an exemplary embodiment of the disclosed antenna device with an annular structure as the contacting structure.

FIG. 5 shows an exemplary embodiment of the antenna device 1 with an annular structure 10 as the contacting structure 6. To form the annular structure 10, the conductive filaments 2 in the carrier fabric 8 are woven at the end of the antenna structure 4 to form an annular loop in the carrier fabric 3. A contacting rivet 11 may again be inserted in the middle of the annular structure 10, as represented in FIG. 5.

Figure 6:
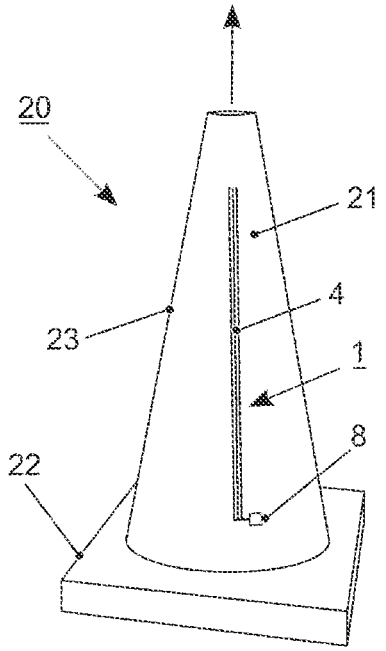
FIG. 6 shows a first exemplary embodiment of a textile article with an antenna device.

FIG. 6 shows a first exemplary embodiment of a textile article 20 with an antenna device 1. The textile article 20 is in this example a foldable cone 21, or road cone. The cone 21 comprises a base 22 and a foldable body 23. The body 23 consists of a carrier fabric, for example, made of polyester or nylon. The cone 21 is unfolded from the base 22 in the direction indicated by the arrow. An exemplary antenna device 1 is incorporated into the body 23, or the carrier fabric. In this example, a rod antenna is replicated by the antenna structure 4 of the antenna device 1. For the contacting of the antenna device, the body 23 comprises a plug-in connector 8.

Figure 7:
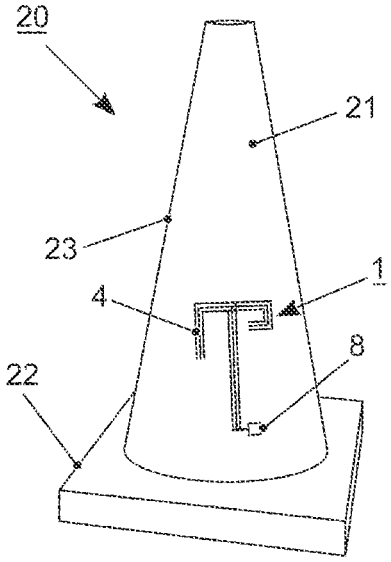
FIG. 7 shows a second exemplary embodiment of a textile article with an antenna device.

FIG. 7 shows a second exemplary embodiment of a textile article 20 with an antenna device 1. The textile article 20 is again a foldable cone 23 having a base 22 and a foldable body 23. In this example, a patch antenna is replicated by the antenna structure 4 of the antenna device 1. For the contacting of the antenna device, the body 23 comprises a plug-in connector 8.

Figure 8:
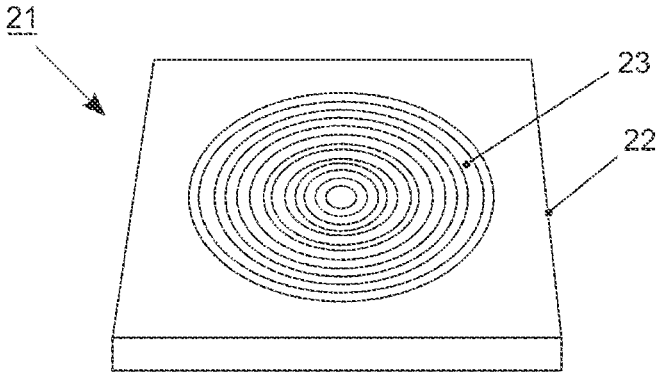
FIG. 8 shows the textile article in a collapsed state.

FIG. 8 shows the cone 21 in a collapsed state. The body 23 disappears almost completely in the base 22. In this state, the cone 21 may be carried or stowed in a space-saving way. For use, the body 23 may simply be deployed upward from the base 22 and the integrated antenna device may, if required, be connected to an external apparatus, so that the cone 21 is ready for use in a very short time.

Figure 9:
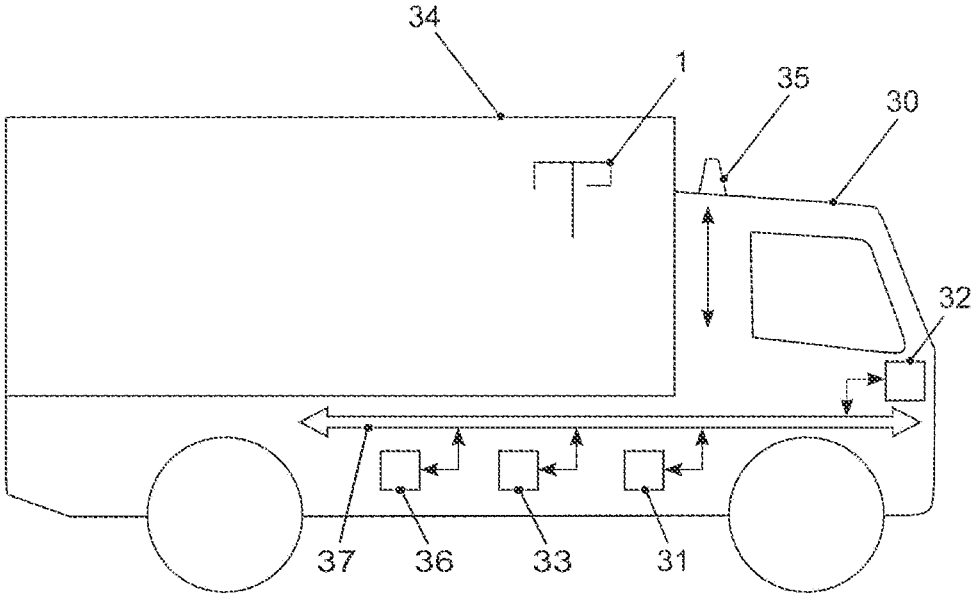
FIG. 9 schematically represents a transportation vehicle with an antenna device.

FIG. 9 schematically represents a transportation vehicle 30 with an antenna device 1. The transportation vehicle 30 is, in this example, a truck. The truck has at least one assistance system 31, which provides an assisted or automated driving function. For this purpose, the assistance system 31 may access data of a sensor unit 32 or of a navigation system 33. The sensor unit 32 may comprise both sensors for registering transportation vehicle states, such as acceleration sensors, wheel rotation speed sensors or gyroscopes, and sensors for registering environmental information, such as cameras, radar sensors, lidar sensors or ultrasound sensors. An exemplary antenna device 1, which may be used for Car2X links, is incorporated into a tarpaulin 34 of the truck. By using a data transmission unit 35, a link may furthermore be set up to service providers. There is a memory 36 for storing data. The data exchange between the various components of the transportation vehicle takes place via a network 37.

Figure 10:
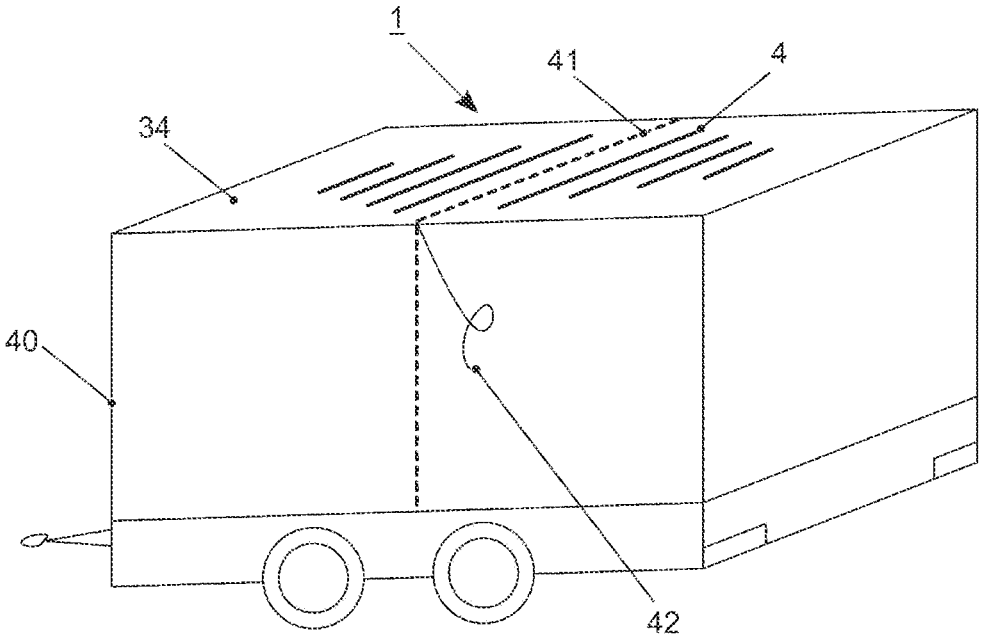
FIG. 10 schematically represents a trailer with an antenna device.

FIG. 10 schematically represents a trailer 40 with an antenna device 1. In this example, a Yagi-Uda antenna is produced. An antenna structure 4 that consists of a number of elements, which are not conductively connected, is placed in a tarpaulin 34 of the trailer 40. A conductive element 41 of the trailer 40 as a fixed structure, for example, a metal crosspiece, is electrically contacted by using a connecting line 42 and is used as a driver element. The elements of the antenna structure 4 in the tarpaulin 34 are used as deflectors and reflectors. The conductive element 41 and the antenna structure 4 together form an overall antenna structure.

LIST OF REFERENCES

1 antenna device
2 conductive filament
3 carrier fabric
4 antenna structure
5 first end
6 contacting structure
7 stranded conductor
8 plug-in connector
9 two-dimensional structure
10 annular structure
11 rivet
20 textile article
21 cone
22 base
23 body
30 transportation vehicle
31 assistance system
32 sensor unit
33 navigation system
34 tarpaulin
35 data transmission unit
36 memory
37 network
40 trailer
41 conductive element
42 connection line

The invention claimed is:

1. An antenna device comprising: a carrier fabric; and a plurality of conductive filaments woven into the carrier fabric so as to be contained within the carrier fabric, wherein the plurality of conductive filaments form an antenna structure within the carrier fabric, wherein the antenna structure forms a contacting structure at a first end of the plurality of conductive filaments, and wherein the plurality of conductive filaments are woven out from the carrier fabric so as to be external from the carrier fabric at the first end, wherein the external conductive filaments at the first end are combined to form a two-dimensional, annular contacting structure configured to contact a corresponding contact rivet on at least two sides of the rivet.

2. The antenna device of claim 1, wherein the antenna structure replicates a rod antenna, a patch antenna or a structure consisting of deflectors and reflectors.

3. A textile article that comprises the antenna device of claim 1.

4. The textile article of claim 3, wherein the textile article is foldable and the antenna structure is stabilized or redefined by unfolding.

5. The textile article of claim 4, wherein the textile article is unfolded in multiple stages so that a shape or length of the antenna structure is varied.

6. The textile article of claim 4, wherein the textile article is folded out so the antenna structure has a defined placement relative to a solid structure.

7. A transportation vehicle, comprising the antenna device of claim 1.

8. The transportation vehicle of claim 7, further comprising a conductive element arranged in a defined placement relative to an antenna structure of the antenna device and configured to function as part of an overall antenna structure.

* * * * *